United States Patent [19]

Montgomery

[11] Patent Number: 4,582,012

[45] Date of Patent: Apr. 15, 1986

[54] INFLATABLE HULL STRUCTURES AND DEMOUNTABLE JOINT BETWEEN ELONGATED STRUCTURAL ELEMENTS

[75] Inventor: Jon A. Montgomery, Teddington, England

[73] Assignee: Gulf Investments International S.A., Panama City, Panama

[21] Appl. No.: 608,699

[22] PCT Filed: Sep. 9, 1983

[86] PCT No.: PCT/GB83/00223

§ 371 Date: May 7, 1984

§ 102(e) Date: May 7, 1984

[87] PCT Pub. No.: WO84/00937

PCT Pub. Date: Mar. 15, 1984

[30] Foreign Application Priority Data

| | | | |
|---|---|---|---|
| Sep. 9, 1982 | [GB] | United Kingdom | 8225799 |
| Sep. 9, 1982 | [GB] | United Kingdom | 8225800 |
| May 27, 1983 | [GB] | United Kingdom | 8314838 |

[51] Int. Cl.[4] ..... B63B 1/10; B63B 7/08

[52] U.S. Cl. ..... 114/61; 114/165; 114/345; 403/400

[58] Field of Search ..... 114/39, 61, 132, 163, 114/165, 345, 162; 441/40, 44, 45; 403/400

[56] References Cited

U.S. PATENT DOCUMENTS

| | | | |
|---|---|---|---|
| 2,646,285 | 7/1953 | Snyder | 403/400 X |
| 3,812,805 | 5/1974 | Forssell et al. | 114/61 |
| 4,218,986 | 8/1980 | Hackney | 114/165 |
| 4,284,024 | 8/1981 | Montgomery | 114/61 |
| 4,348,971 | 9/1982 | Montgomery | 114/61 |

*Primary Examiner*—Sherman D. Basinger

*Attorney, Agent, or Firm*—Flynn, Thiel, Boutell & Tanis

[57] ABSTRACT

A demountable catamaran has a pair of inflatable hull structures each comprising an inflatable hull tube (4) and an extruded generally rectangular aluminium tubular beam (5) having at its lower surface two inclined support surfaces on opposite sides of a channel having a narrow entry. The hull tube (4) has an upstanding web extending through the entry to carry an enlarged bead (15) within the channel to lock the inflatable tube to the hull beam (5). The hull beams (5) are secured by demountable joints to cross beams (2) and (3). The seam of each hull carries a rudder assembly which can yield when the rudder hits an underwater obstruction.

9 Claims, 17 Drawing Figures

INFLATABLE HULL STRUCTURES AND DEMOUNTABLE JOINT BETWEEN ELONGATED STRUCTURAL ELEMENTS

FIELD OF THE INVENTION

The present invention relates to demountable joints between elongated structural elements which are to be secured to each other at an angle, typically 90°. The invention also relates to inflatable hull structures for boats. Two or more such hull structures may be detachably secured to cross beams by the demountable joints to form a multi-hull boat such as a catamaran.

The present invention also relates to rudders and is particularly suitable in respect of sailing boats such as dinghies and catamarans.

BRIEF DESCRIPTION OF THE DRAWINGS

The invention which is defined in the claims, will now be further described by way of example with reference to the accompanying drawings, in which:

DETAILED DESCRIPTION

Figure 4:
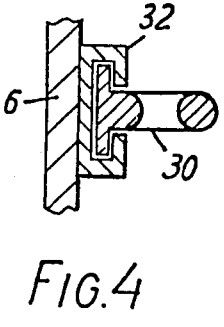
FIG. 4 is a cross-section on the line IV—IV of FIG. 2 on a further enlarged scale.

The demountable catamaran shown in the drawings comprises a pair of hull structures 1 interconnected by detachable cross-beams 2 and 3. Each hull structure 1 comprises an inflatable hull 4 in the form of a tube of cross-section which varies along its length to give the required form to the hull, a hull beam 5 extending along the top of the hull, a bow member 6 interconnecting the tapered down bow of the hull tube 4 with the hull beam 5, and a stern post 7 carrying a rudder assembly 8, the rudder assemblies being linked by a tiller link tube 9.

Figure 3:
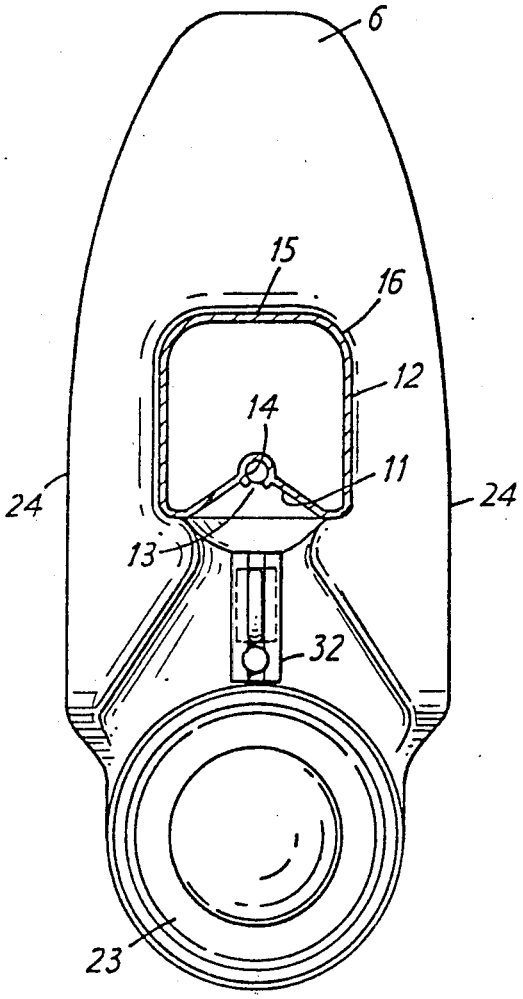
FIG. 3 is a vertical cross-section on the line III—III of FIG. 2.
Figure 5:
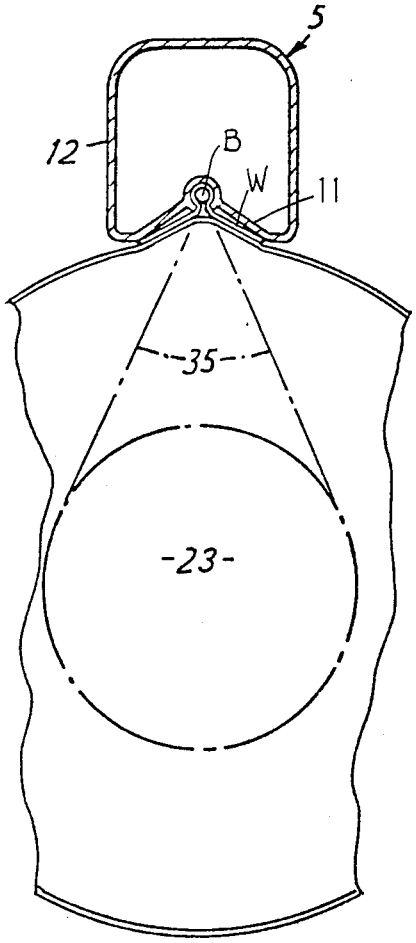
FIG. 5 is a cross-section on the line V—V of FIG. 1.

As is shown clearly in FIGS. 3 and 5, each hull beam 5 is of generally rectangular tubular construction, being formed from a length of aluminium alloy extrusion, suitable alloys being those used for yacht masts such as international designation 6082 in condition TF. The bottom wall of the hull beam 5, however, consists of two support surfaces or flanks 11 which slope upwards at about 30° to the horizontal from near the bottom edges of side walls 12 of the hull beams to an entry portion 13 leading into a channel 14 which is conveniently shaped as the major portion of the circle. Where the entry portion 13 meets the channel 14, the width of the entry portion is further reduced by a nose formation on each side of the entry to the channel 14 thereby further reducing the width of the resulting throat and providing an increased thickness of metal at the bottom two edges of the channel 14. The hull beam extrusion is completed by a top wall 15 which is joined to the top edges of the side walls 12 by arcuate portions 16. The extrusion may for example have a wall thickness of 2 mm, a height of 85 mm and width of 80 mm.

Each hull tube 4 is constructed of suitable flexible air tight and water tight material, such as woven nylon cloth coated with polyurethane. Along its top edge, each hull beam has an upstanding rib consisting of a web portion W and a bead B. The height of the web portion W and diameter of the bead portion B of the rib are such that with the hull 4 deflated or only partially inflated, one end of the bead B can be introduced into an end of the channel 14 and then slid along the channel to the other end, thus drawing the remainder of the bead B into the channel 11.

Since the bead B is clearly much thicker than the throat of the entry portion 13 to the channel 14, it cannot be pulled downwards out of the channel through the entry portion. Thus, when the hull 4 is fully inflated, it will expand into bearing contact with the wall portions 11 and apply tension to the web W. As a result, the hull tube 4 is now firmly anchored to the hull beam 5 effectively uniformly along its full length.

Conveniently, the web W and bead B can be formed by a 96 mm wide strip of woven nylon cloth folded around a bolt rope or cord (to form the bead B), with adjacent portions secured together to form the web, the marginal portions being fixed to the inflatable hull by an appropriate (impact) adhesive and forming the bearing areas to contact the surfaces 11. The inner face of this strip is coated with polyurethane but the outer surface is preferably left uncoated to assist sliding in the channel 13, 14 prior to full inflation of the hull.

Figure 1:
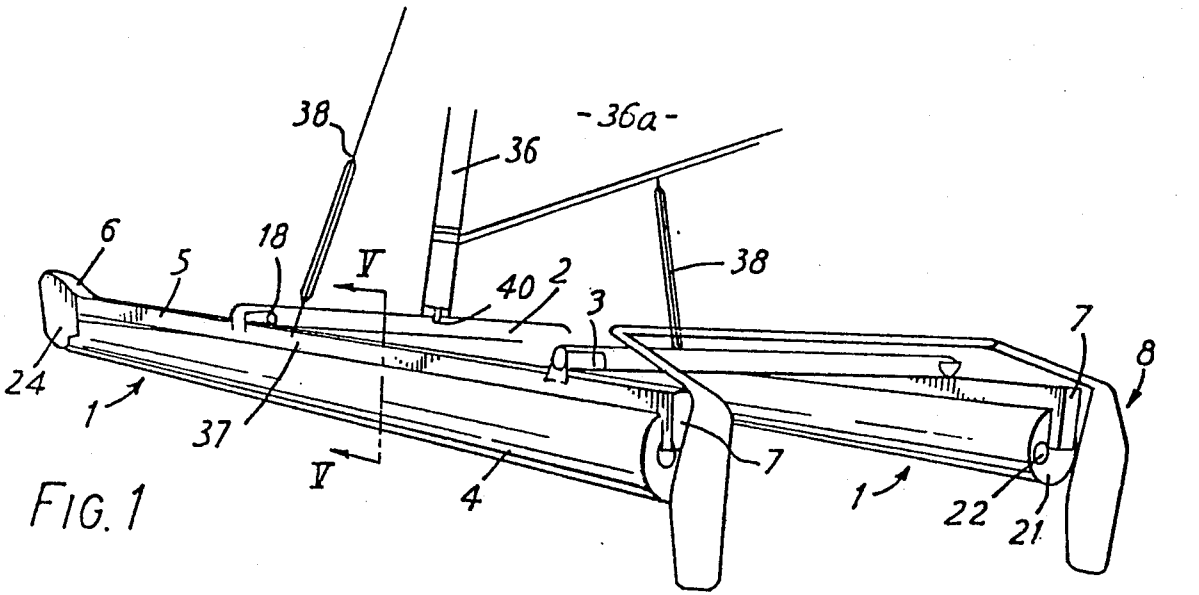
FIG. 1 is a perspective view of a catamaran embodying the invention.

As shown in FIG. 1, each of the cross beams 2 and 3, can be formed from a length of substantially circular extrusion of the same material as the hull beams 5. Each cross beam 2, 3 is detachably secured above the top of each hull beam by a set of brackets 18 and stainless steel bolts as described below with reference to FIGS. 8 to 13.

As explained above, the hull 4 when fully inflated is firmly anchored to the hull beam 5 which is in contact with the hull 4 over a large area and over substantially the whole length of the hull except the foremost part thereof, so that substantial loads can be applied to the hull without creating large local pressures which would deform the hull. At the same time, during assembly, the structure can accommodate minor dimensional charges in the hull which may for example occur during early use or aging of the hull.

Figure 7:
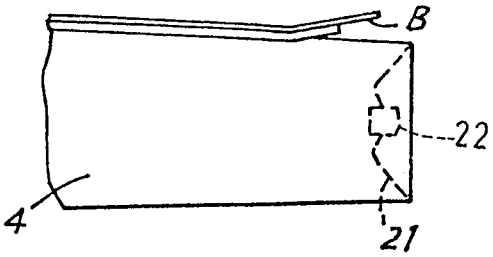
FIGS. 6 and 7 are plan and side elevationsl views of the aft end of one of the inflatable hulls.
Figure 6:
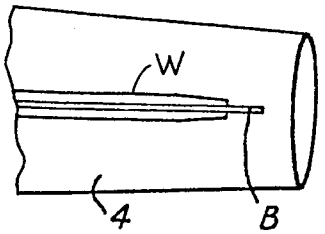

As can be seen in FIGS. 6 and 7, the height of the web portion of the anchoring rib of the hull tube preferably increases over the aftermost end of the rib, for example for a distance of about 100 mm. This performs a stress-relieving operation on the aft end of the rib to prevent tearing of the end of the rib under the highly concentrated forces which would otherwise be exerted on it by the high lateral forces exerted on the hull tube for example when the helm is suddenly put hard over.

In order to form a bluff stern to the hull tube 4, the aft end of it is bonded to the periphery of a dished circular rigid plate 21 which carries an inflation valve 22.

The stern post 7 also carries conventional pintle brackets for mounting the rudder assembly 8.

The circular plate 21 should be spaced from the stern post 7 to prevent chafing.

Figure 2:
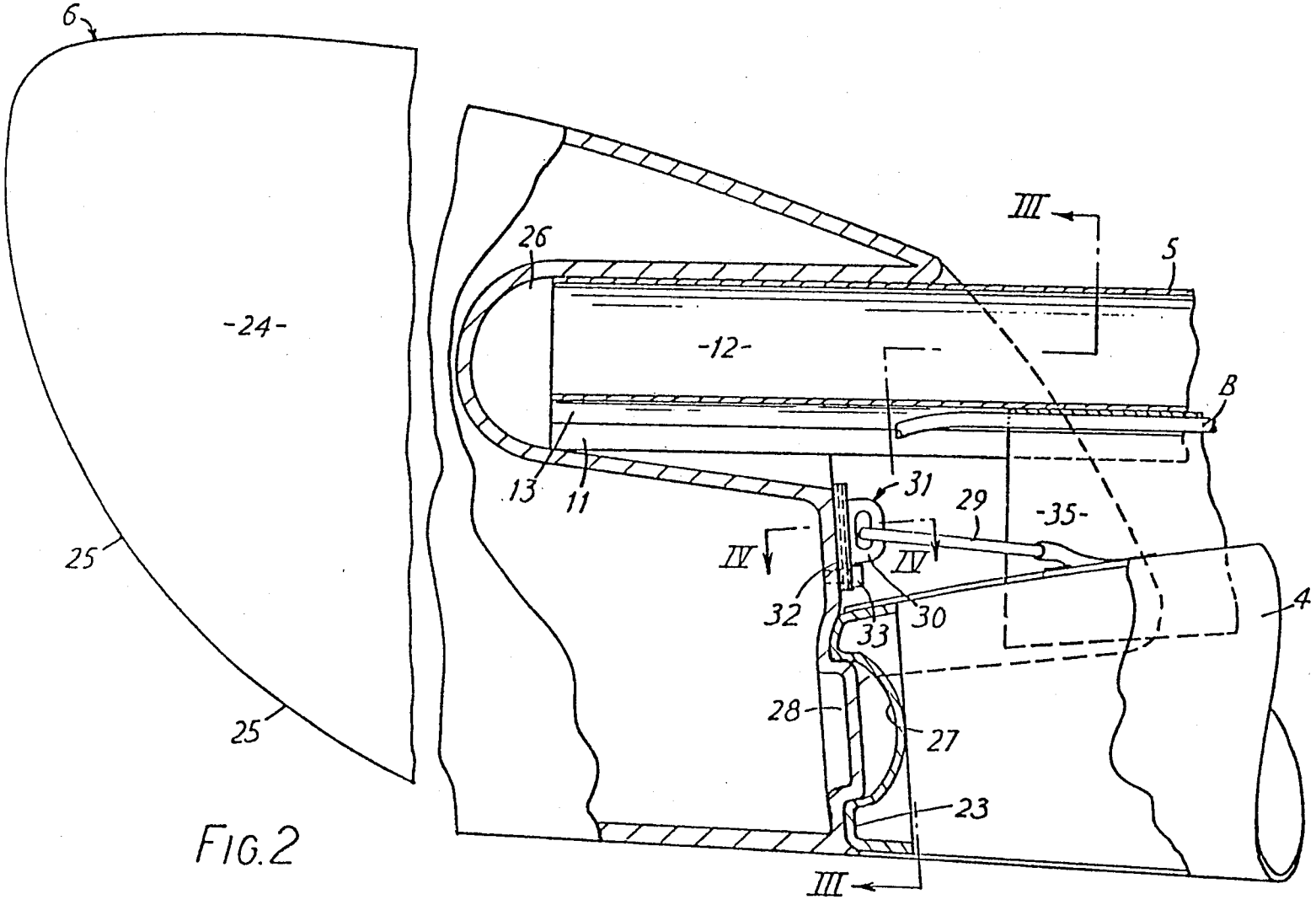
FIG. 2 show a a bow of the catamaran partly in elevation and partly in longitudinal section, on an enlarged scale.

At its bow end, the hull tube 4 tapers down to be bonded to a smaller diameter dished bow plate 23, (FIGS. 2, 3 and 5) and in this region is spaced from the hull beam 5. In accordance with British Patent Specification No. 2024112 (U.S. Pat. No. 4,284,024) the bow member 6 forms a pair of bow cheeks 24 meeting at a sharp bow stem 25.

The bow member 6 is hollow and formed by a rotational moulding method from polypropylene. In its upper aft face is formed a socket 26 to receive and engage the forward end of the hull beam 5, the bow member being mounted on the hull beam after the hull tube 4 has been assembled to the hull beam.

The forward dished plate 23 has a central depression 27 which snugly engages on a circular boss 28 on the bow member 6. The boss 28 is surrounded by a shallow annular depression receiving the outer portion of the dished plate 23. This arrangement ensures positive location of the forward end of the hull 4 in all radial directions.

To hold the plate 23 and boss 28 in contact, a loop of cord 29 secured to the hull 4 passes through the eye 30 of a nylon slider 31 which can be slid into a short vertical track 32 glued and screwed (at 33) to the bow member 6. Once the slider 31 has been engaged in the track 32, the bow member can be engaged on the hull beam, the hull tube can be finally adjusted relative to the hull beam and then inflated.

To close the gap between the hull beam and the forward tapering portion of the hull 4, a further piece of nylon cloth 35 is folded at its middle over the bolt rope B, forming a forward extension of the bead and bonded at its lower margins to the tapering hull 4.

To complete the boat as a sailing boat, a mast 36 (with sail 36*a*) can be mounted in the centre of the front cross beam 2 at 40 and stayed by stays such as 38 to suitable points 37 on the hull beams 5. A trampoline deck (not shown in FIG. 1) extends over the area between the cross beams 2 and 3 and the hull beams 5.

Also, dagger boards (not shown), of profile similar to the rudders, may be mounted in frames (not shown) fixed to the inboard side of each hull beam, between the cross members.

Since there is only a single rib W, B, the rib does not have to be positioned with extreme accuracy since the flexible hull can accommodate minor inaccuracies without causing major stresses or wrinkles.

In FIGS. 8 to 13 is shown a demountable joint between a hull beam 5 and an end of a tubular cross beam 2 or 3. A pair of first brackets 55A and 55B is secured to the flat side face 53 of the hull beam 5. A pair of second brackets 56A and 56B is similarly secured to the opposite face 54 of the hull beam 5. The brackets 55 are formed from metal sheet or plate having the outline shown in FIG. 12 while the brackets 56 are similarly formed from plate or sheet metal having the outline shown in FIG. 13. Thus, each bracket 55 has a mounting portion 57 which is bonded to the face 53 and further secured by rivets 58 which pass through holes 59 in the mounting portions 57 and corresponding holes drilled in the face 53. Each bracket 55 also has a bridge portion 61 connected to the mounting portion 57 by a bend zone 60 which forms a quarter of a cylinder as the result of the bending operation to place the bridge portion 61 at right angles to the mounting portion 57. This bending operation takes place in opposite directions for the opposite-handed brackets 55A and 55B.

Each bridge portion 61 has an upper flange 62 which is bent through an angle of 30° to the remainder of the bridge portion 61 about a bend line 63. The flange 62 is formed with two spaced holes 64 and 65.

The second bracket 56 also comprises a generally triangular mounting portion 66 and a flange portion 67 which is connected to the mounting portion 66 by a bend zone 68, the plate 56 being bent in the zone 68 to bring the flange 67 at right angles to the mounting portion 66. This bending takes place in opposite directions for the opposite-handed second brackets 56A and 56B. The flange 67 has a hole 69 of the same diameter as the hole 65 while the mounting portion 66 is formed with a pattern of four rivet holes 70 to enable the mounting portion to be bonded and rivetted to the face 54.

The preferred method of assembly of the connection is as follows. The cross beam 2 (or 3), which is of generally circular cross section but is formed with two diametrically opposed flat surfaces 73, has two pairs of diametrically opposed holes drilled through the flat surfaces. The spacing of the holes in each flat surface corresponds to the spacing of the holes formed in the brackets 55. The pair of opposed holes nearer to the end of the cross beam is spaced from that end by a distance corresponding to the distance between the holes 64 and the mounting portions 57 of a bracket 55. Thus, a bracket 55 may conveniently be used as a template when marking off the correct positions for the holes to be drilled.

The holes 65, 69 of respective brackets 55, 56 are held in alignment while a stainless steel bush 71 having a flange at one end is passed by its other end through the aligned holes and thereafter swaged to secure the portions 62 and 67 of the respective brackets permanently but pivotally together. Similar bush can be inserted and secured in the hole 64 to act as a protective bush for the hole, as the joint is in constant use.

Spacer tubes 74 (FIGS. 8 and 11) are inserted into the end of the tube 2 or 3 and are positioned in alignment with each pair of opposed drilled holes. The tubes 74, thus disposed diametrically in the tube 2 or 3, are secured in the tube by bushes 75, carefully pressed into the ends of the tubes 74.

The pivotally connected brackets 55A, 56A and 55B, 56B are now joined to the cross beam. A bolt 76, 76A is passed through each spacer tube 74. The bolt 76 further from the end face of the tube 2 or 3 also passes through the aligned holes 65, 69 of both brackets. The other bolt 76A passes through the holes 64 of brackets 55A and 55B. A nut 77 is engaged on the threaded end of each bolt. The nuts are tightened, only moderately at this stage, enabling the brackets 56A and 56B to be rotated about the bolt 76 on bush 76.

The cross-beam 2 or 3 is now joined to the hull beam 5. The latter is located in blocks and the cross-beam and is attachments are lowered onto it, with the end of the cross-beam aligned with the face 53 of the hull beam. In this position the flange 67 of each brackets 56A, 56B is adjacent to the side face 54 of the hull beam 5 and the mounting portion 57 of each bracket 55A, 5B is adjacent to the side face 53. The brackets 56A, 56B are first bonded and then rivetted to the face 54. If the brackets 55A and 55B are not precisely aligned with the face 53 they may easily be deformed into aligment, prior to bonding and rivetting to the face 53.

It will be appreciated that this method of assembling the apparatus is applicable to hull beams whose faces 53, 54 are not perfectly parallel. This adaptability arises from the fact that the brackets 56A, 56B may be rotated about the axis of the bolt 76 prior to the fixing of the brackets to the hull beam, and from the fact that the brackets 55A, 55B may be deformed into alignment with the face 54.

Once all four brackets have been fixed to the hull beam the nuts 77 are fully tightened on the bolts 76, 76A.

Manipulation and tightening of the bolts and nuts is facilitated by using moulded nylon nut retainers 78 under the heads of the bolts and to receive the nuts, these retainers having a hexagonal recess to receive and grip the hexgonal portions of the bolt heads or nuts.

The bridge portions 61 of the first brackets with the flanges, together with the bead zones 60 and the upper parts of the mounting portions 57 act as fairings and help to give the joint a neat appearance.

Figure 8:
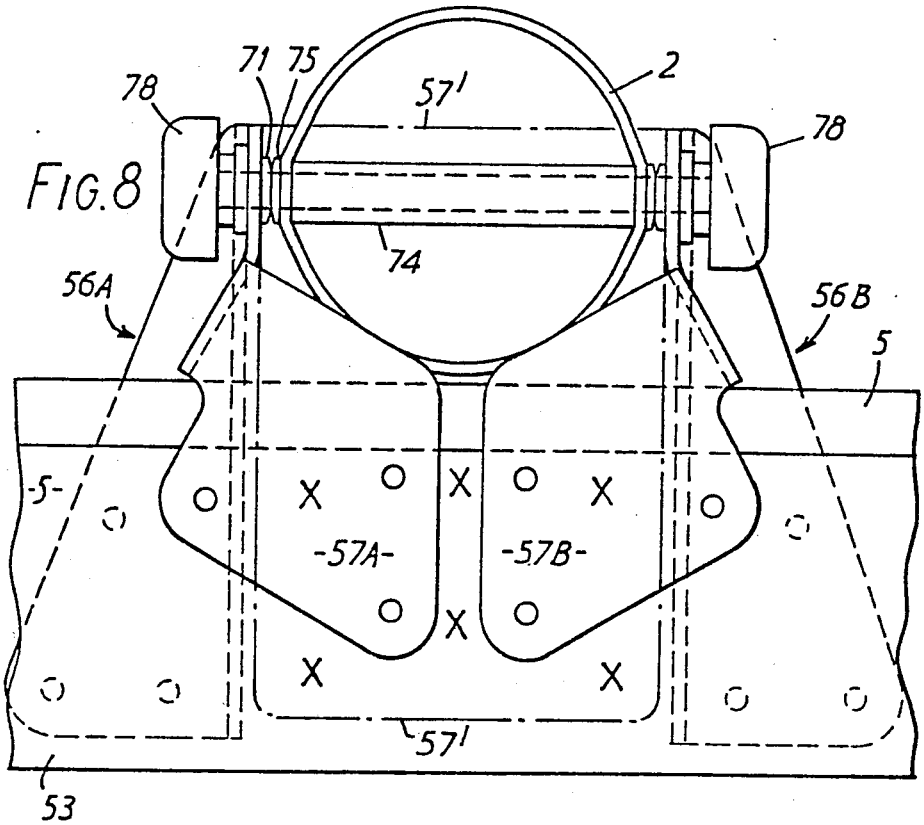
FIG. 8 is an elevational view of a portion of the side of the framework of the catamaran showing the connection of a cross beam to a hull beam.
Figure 9:
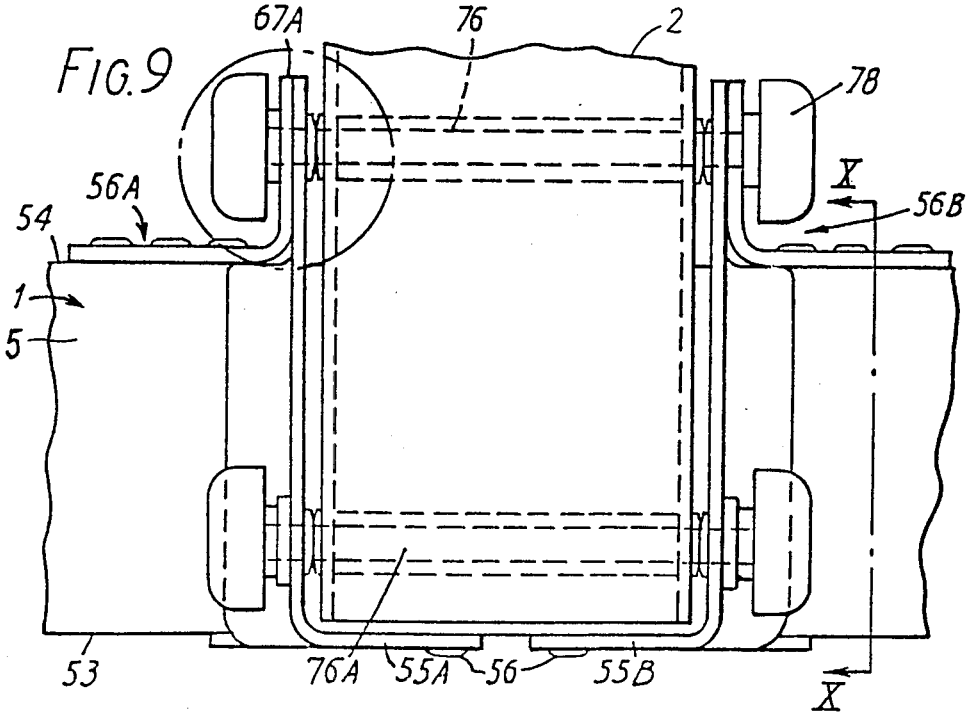
FIG. 9 is a plan view of the connection shown in FIG. 8.
Figure 10:
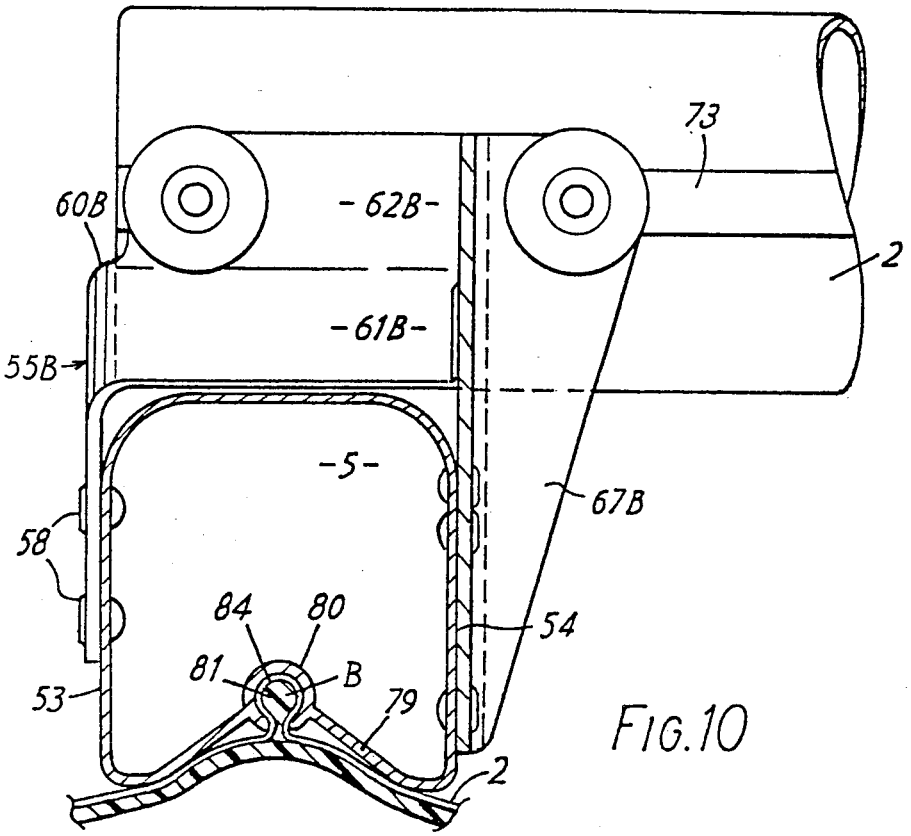
FIG. 10 shows a vertical cross section on the line X—X of FIG. 9.
Figure 11:
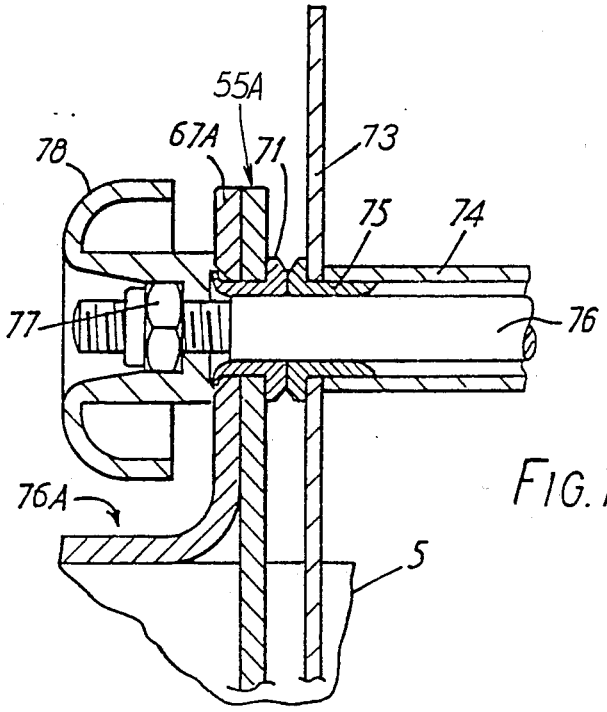
FIG. 11 shows in cross section the portion within the circle XI of FIG. 9 on an enlarged scale.
Figure 12:
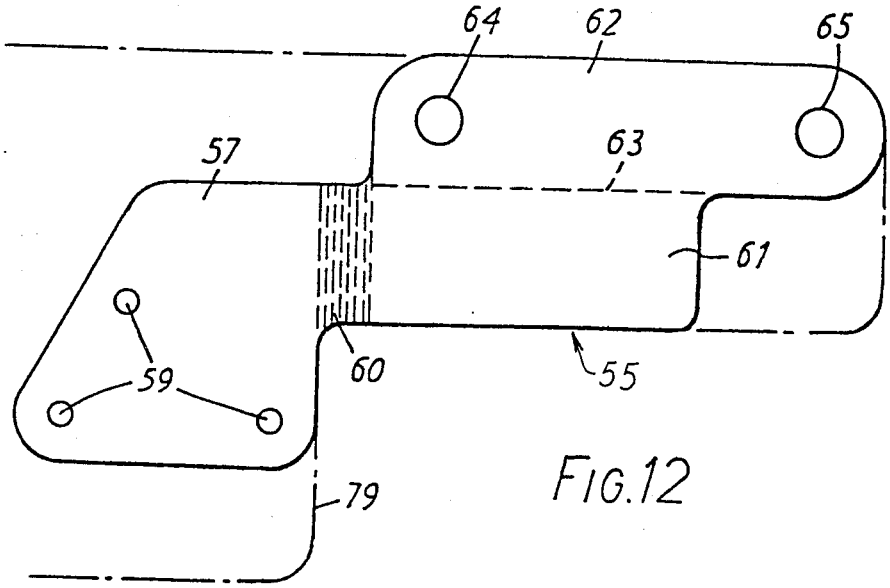
FIGS. 12 and 13 show the first and second brackets in flattened form, prior to bending.
Figure 13:
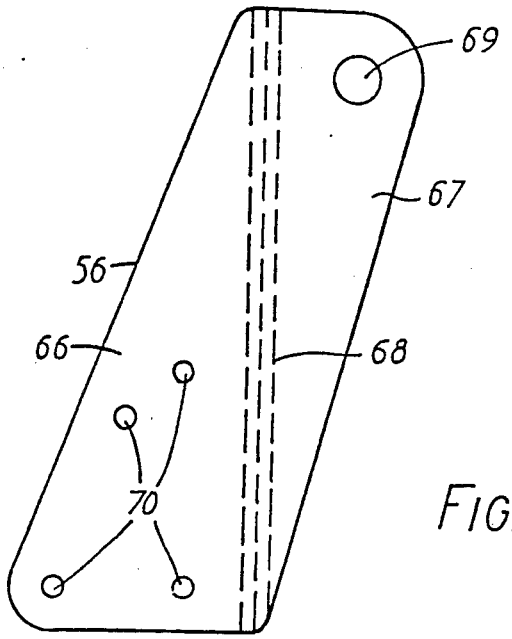

In a modified construction, the brackets 55A and 55B are formed from a single plate of metal of squat T-shape, the stem of which forms a rectangular common mounting portion 57' shown in chain-dotted line outline in FIG. 8 and extending up to the level of the top of the brackets 56A and 56B. The two arms of the T-shaped plate are bent at right angles to the mounting portion to lie in vertical planes on each side of the tube 2 or 3 and thus from the bridge portions equivalent to 62A and 62B but extending vertically downwards to just above the top surface of the level beam. The rivet positions are shown at X in FIG. 8. One half of the outline of the plate, before bending, is shown in chain-dotted outline 79 in FIG. 12.

Figure 14:
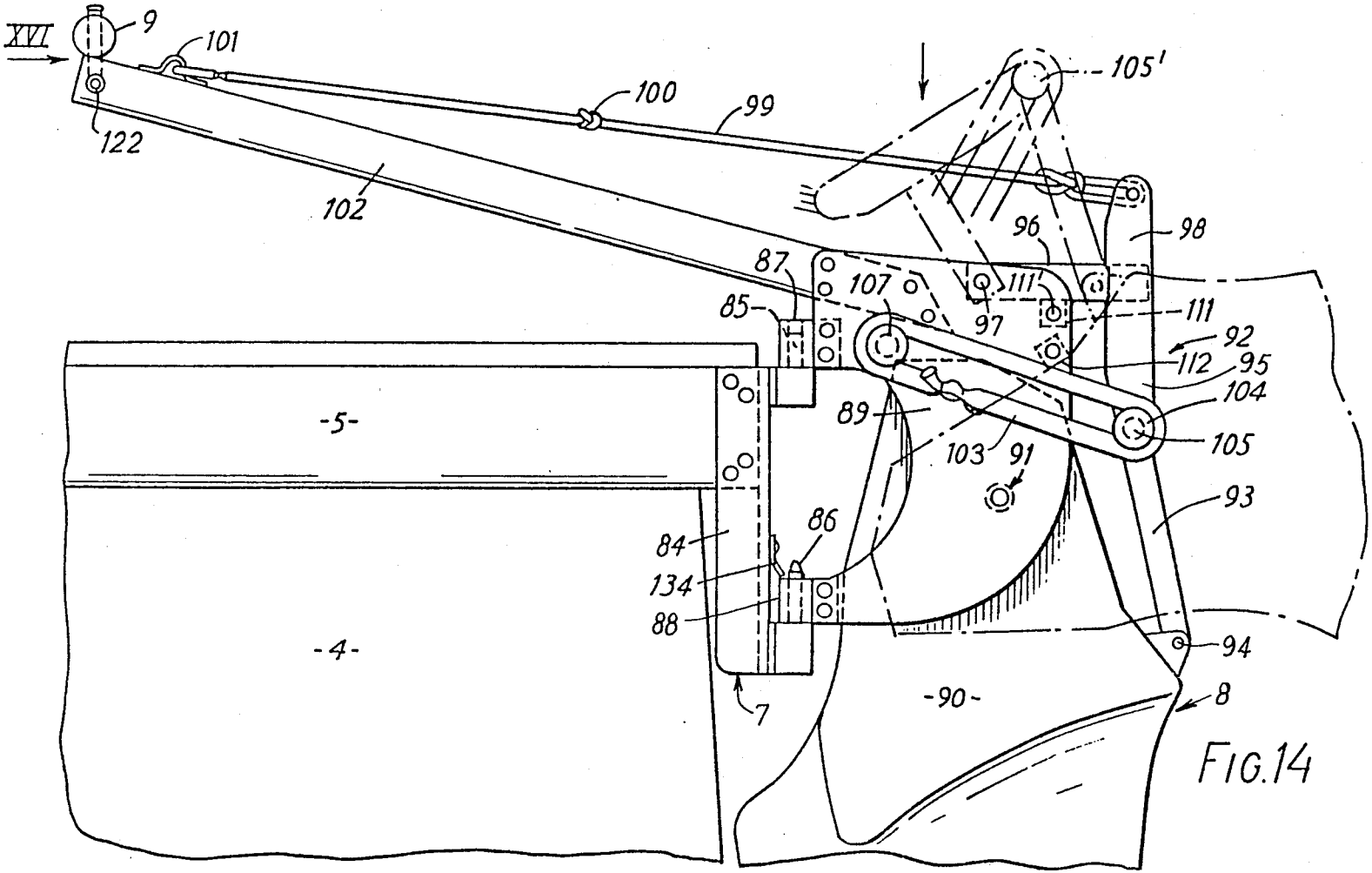
FIG. 14 is a side elevational view of the stern of one hull showing the components of the rudder.
Figure 15:
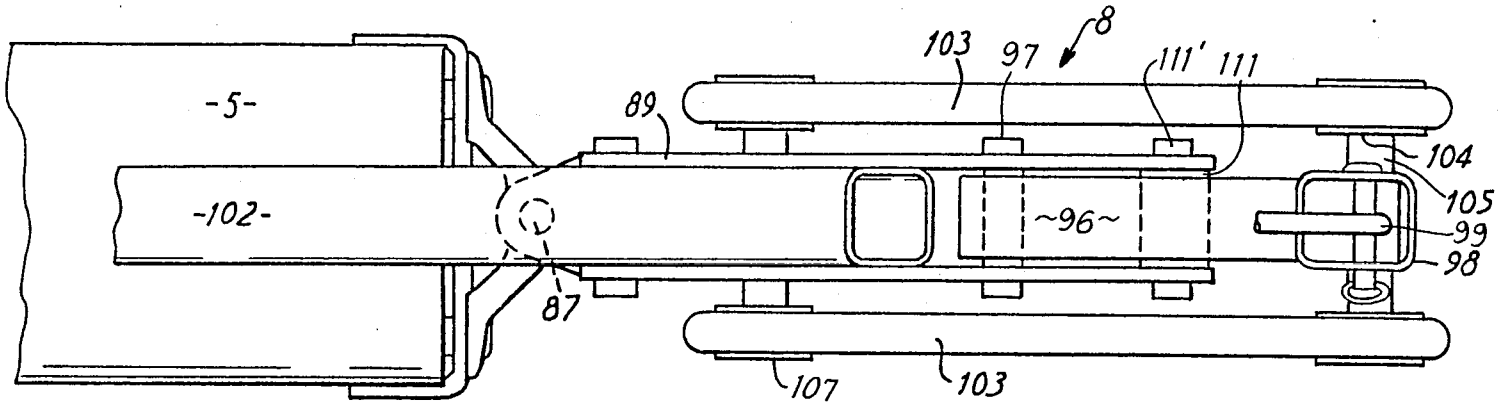
FIG. 15 is a plan view of the rudder shown in FIG. 14.
Figure 16:
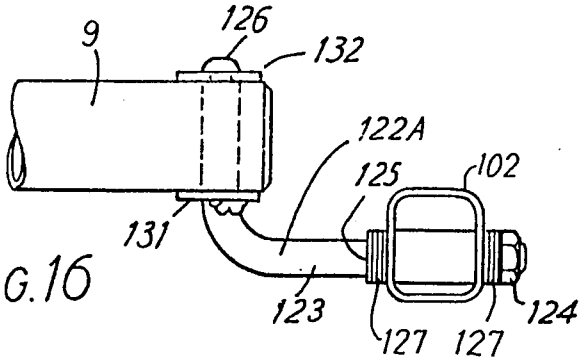
FIG. 16 is a view on an enlarged scale of the connection between the connecting rod and tiller shown in FIG. 14 in the direction of the arrow XVI.
Figure 17:
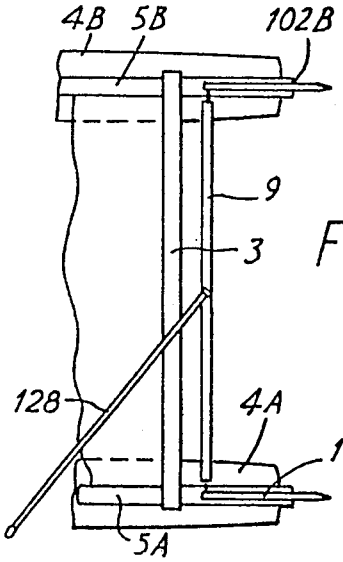
FIG. 17 is a plan view of the stern of the catamaran showing the linkage between the two tillers.

FIGS. 14 to 16 show a rudder assembly which is particularly suitable for the catamaran described above but may be used on other boats. The stern post transom 7 is rivetted to the aft end of the hull beam 5 and carries upper and lower pintles 85 and 86 for the gudgeons 87 and 88 of a rudder stock 89 consisting of two flat parallel plates rivetted to the gudgeons 87 and 88.

A hydro-foil rudder blade (of which only the upper mounting part 90 can be seen in FIGS. 14 and 15) fits between the two plates of the rudder stock 89 and is pivoted to them by means of a cross tube and bolt arrangment 91. The rudder blade can thus swing from the position shown in full lines to the position shown in broken lines but is constrained to turn with the rudder stock.

A hinged linkage 92 has the lower end of its lower link 93 pivoted at 94 to a lug on the rudder blade 90. The upper link 95 is effectively cranked to have a forward extension 96 which is pivoted at 97 to the top of the rudder stock. The upper link 95 has an upward extension 98 which is connected by a length of line 99 formed with a hand grip knot 100 to a mounting staple 101 near the forward end of the tiller arm 102 rivetted to the rudder stock plates.

On each side of the rudder, elastic cord 103 formed into an endless loop extends forward from pulley-like mountings 104 on the hinge pivot 105 of the linkage 92 to similar mountings 107 fixed to the rudder stock plates 89.

The operative position of the rudder blade 90 is determined by a stop 111 against which the underside of the portion 96 of the upper link engages. The stop 111 is vertically adjustable, for which purpose it is secured between the two rudder stock plates by a cross bolt 111' passing through the stop 111 and through vertical slots (not shown) in the rudder stock plates.

In use, if the rudder blade should hit an underwater object or a sharp pull is exerted on the line 99, the upper link 96 will be swung about its pivot 97 with consequent stretching of the cords 103 until the hinge 105 passes the line connecting the points 107 and 97 after which the tension in the cords will continue upward swinging movement of the rudder blade 90 until it abuts a further stop 112. The rudder blade 90 may be restored to its operative position by rotating the upper link 95.

When launching the boat in shallow water, an intermediate position for the rudder may be obtained in which the toe of the rudder blade is just in the water. For this purpose the forward end of the line 99 is looped over the forward end of the tiller arm 102.

As shown in FIGS. 15 and 16, the tiller arms 102A and 102B of the catamaran are interconnected by the connecting tube 9, the ends of which are pivotally connected to cranked pivot pins 122, the horizontal portions 123 of which pass through the tiller arms to be secured by a nut 124 and a welded-on collar 125, on opposite sides of the tiller arm 102. The precise position of the pivotal connection (i.e. of the upright portion 126) may be adjusted by selection of the number and thickness of shims 127. With this arrangement, a form of Ackermann steering is obtained. A central tiller handle 128 is pivoted to the centre of the connecting tube 9.

The ends of the connecting tube 9 rest on washers 131 (FIG. 16) welded to the vertical portions of the pivot pins. The projecting upper ends of each such pin has a groove to fit in the narrower part of a keyhole shaped opening in a retaining plate 132 connected by a line to the staple 101 to prevent loss of the plate 132.

To avoid accidental separation of each rudder from its hull, each transom 84 carries a spring catch 134 formed by a leaf spring rivetted to the transom and normally projecting over the top of the lower gudgeon 86. The catch can easily be pressed flat agianst the transom when it is desired to remove the rudder.

I claim:

1. An inflatable hull structure for a multihull boat, comprising an elongate inflatable hull tube, a rigid tubular hull beam, said hull beam being substantially coextensive in length with said inflatable hull tube, said inflatable hull tube being demountably anchored to said hull beam, a forward end member at the tip of said inflatable hull tube, the forward end of said inflatable hull tube tapering down to said forward end member, and a bow member, said bow member being formed with bow cheeks meeting at a bow stem, said bow member having a socket engaged upon the forward end of said hull beam in a manner resisting rotation, said inflatable hull tube forward end member and said bow member having interfitting conformations, and releasable securing means holding said bow member and said forward end member of said inflatable hull tube in engagement.

2. The structure according to claim 1, in which said forward end member is a dished plate spaced below said hull beam and having a central depression which snugly engages on a circular boss on the bow member, said boss being surrounded by a shallow angular depression receiving the outer portion of said dished plate to ensure positive location of the forward end of the hull in all radial directions with respect to said bow member, said releasable securing means comprising a length of cord secured to the hull tube and passing through the eye of a nylon slider slidably secured in a short vertical track fixed to the aft face of the bow member, and a cloth piece having a fold adjacent to the underside of said hull beam and extending downward into bonded engagement with the forward portion of the hull tube adjacent and between the bow cheeks of the bow member.

3. In a multihull boat comprising a plurality of hulls each having a hull beam and a cross beam for connecting said hulls, the improvement comprising a demountable joint between a first said beam and a second said beam, said first beam having first and second sheet metal brackets on opposite lateral face portions thereof, the brackets extending laterally of the first beam and each having an aperture receiving a respective fastening element, both brackets being secured by said fastening elements to the second beam at positions spaced apart along the latter, the first bracket having an extension forming a bridge across the first beam and a registration portion extending from said bridge and secured to the apertured part of the second bracket.

4. The structure defined in claim 3, wherein the said registration portion is formed with an aperture which is aligned with the aperture in the second bracket and a bush extends through these two aligned apertures to secure the registration portion of the first bracket to the second bracket and to form the aperture for the relevant fastening element.

5. The structure defined in claim 4, wherein the arrangement of first and second brackets is repeated on the first beam in a position where they will be on the opposite side of the second beam, with the bushes of the two brackets aligned.

6. The structure defined in claim 5, wherein said two first brackets and a spacing portion therebetween are formed from a single piece of sheet metal.

7. A rudder assembly comprising a rudder stock for pivotal mounting on the stern of a hull structure, a rudder blade pivoted adjacent its upper end to the rudder stock about a horizontal axis, said rudder blade having alternate operative and raised positions achieved by pivoting thereof about said axis, a hinged linkage comprising a lower link hinged to a point on the rudder blade, which point is below the pivot of the rudder blade with the rudder blade in its operative position, said lower link being hinged at its upper end to a lower end of an upper link hinged at its upper end to a first point on the rudder stock above said rudder blade pivot, elastic means acting between the hinge point of the hinged linkage and a second point on the rudder stock, the line of action of the elastic means lying below said first point with the rudder in its operative position.

8. A rudder assembly according to claim 7, wherein a tiller arm is secured to the rudder stock, a substantially inextensible and flexible member connects a leading part of the tiller to an upward extension of said upper link so that the rudder blade can be swung to its upper position by pulling on the flexible member.

9. A rudder assembly according to claim 8, wherein said line of action of said elastic means is substantially parallel to said tiller arm.

* * * * *